US010116094B2

(12) United States Patent
Byrne et al.

(10) Patent No.: US 10,116,094 B2
(45) Date of Patent: Oct. 30, 2018

(54) DATA-SECURE CONNECTOR WITH INDICATOR

(71) Applicants: Norman R. Byrne, Ada, MI (US); Timothy J. Warwick, Sparta, MI (US); Nickolas J. Morrow, Ada, MI (US)

(72) Inventors: Norman R. Byrne, Ada, MI (US); Timothy J. Warwick, Sparta, MI (US); Nickolas J. Morrow, Ada, MI (US)

( * ) Notice: Subject to any disclaimer, the term of this patent is extended or adjusted under 35 U.S.C. 154(b) by 0 days.

(21) Appl. No.: 15/676,016

(22) Filed: Aug. 14, 2017

(65) Prior Publication Data

US 2018/0048093 A1 Feb. 15, 2018

Related U.S. Application Data

(60) Provisional application No. 62/374,092, filed on Aug. 12, 2016.

(51) Int. Cl.

| | |
|---|---|
| ***H01R 4/24*** | (2018.01) |
| ***H01R 13/641*** | (2006.01) |
| ***H01R 13/703*** | (2006.01) |
| ***H01R 43/26*** | (2006.01) |
| ***H01R 27/02*** | (2006.01) |
| ***H01R 25/00*** | (2006.01) |

(52) U.S. Cl.
CPC ..... *H01R 13/641* (2013.01); *H01R 13/703* (2013.01); *H01R 25/006* (2013.01); *H01R 27/02* (2013.01); *H01R 43/26* (2013.01)

(58) Field of Classification Search
CPC .... H01R 43/26; H01R 13/641; H01R 13/703; H01R 25/006; H01R 27/02; G06F 1/632; H02G 3/185; H02J 5/005
USPC ..... 439/490
See application file for complete search history.

(56) References Cited

U.S. PATENT DOCUMENTS

| | | | | |
|---|---|---|---|---|
| 9,438,070 | B2 * | 9/2016 | Byrne | H02J 5/005 |
| 2014/0355231 | A1 * | 12/2014 | Byrne | H02G 3/185 361/756 |
| 2017/0177031 | A1 * | 6/2017 | Lesizza | G06F 1/1632 |
| 2017/0258246 | A1 * | 9/2017 | Schwalbach | A47F 3/001 |

* cited by examiner

*Primary Examiner* — Jean F Duverne
(74) *Attorney, Agent, or Firm* — Gardner, Linn, Burkhart & Ondersma LLP

(57) ABSTRACT

A data-secure electrical connector is operable to provide electrical power to a portable electronic device via a connector that is capable of transmitting electrical power and electronic data to the device, but without establishing an electronic data connection with the device, while providing an indicia to a user when the data-secure electrical power connection has been made.

19 Claims, 3 Drawing Sheets

DATA-SECURE CONNECTOR WITH INDICATOR

CROSS REFERENCE TO RELATED APPLICATION

The present application claims the filing benefits of U.S. provisional application Ser. No. 62/374,092, filed Aug. 12, 2016, which is hereby incorporated by reference herein in its entirety.

FIELD OF INVENTION

The present invention relates to electrical power and data receptacles.

BACKGROUND OF THE INVENTION

Electrical power connectors used for recharging portable electronic devices (such as cellular telephones or smart phones, tablet computers, portable media players, and the like) frequently also have electronic data capability. For example, connecting one's mobile phone to a USB charging port in a modern automobile may cause the automobile's entertainment system to attempt to download or access personal contacts, playlists, and other personal information stored on the phone, or stored in databases (including "cloud storage") that are accessible via the phone. USB charging ports are frequently provided in work areas and public spaces, including transportation terminals such as airports, and these USB charging ports look the same, or substantially the same, regardless of whether or not they are data-capable. Therefore, users of such connectors may be concerned about inadvertently or unintentionally establishing a data connection to an unknown electronic communications source when connecting their portable electronic device purely for recharging purposes, which gives rise to concerns over electronic data security. Therefore, persons using such charging ports often have no knowledge or assurance as to whether a data connection is also being established to their portable electronic device when they connect it to the USB charging port.

SUMMARY OF THE INVENTION

The present invention is a data-secure electrical power receptacle that provides a user with a clear visual, audible, or other sensory indication that a power-only connection has been established with the receptacle by either a power-only plug or a power-and-data plug associated with the user's portable electronic device. In this manner, the user of a portable electronic device having both electrical charging and electronic data transmission capability through a single power-and-data connector, quickly receives a signal or indicia from the receptacle, when the receptacle is engaged by the power-and-data connector, that assures the user that no electronic data connection has been established between the portable device and the receptacle.

In one form of the present invention, a data-secure low voltage power connector includes a connector housing, and electrical receptacle having at least two electrical contacts, and an indicator. The connector housing has a front face defining a receptacle opening through which the electrical receptacle is accessed by a power-only electrical connector or a power-and-data electrical connector associated with an electrical consumer. The electrical contacts are electrically energized by a power source and convey electrical power to the electrical consumer upon engagement of the electrical contacts by the power-only or the power-and-data electrical connector. The indicator is in selective electrical communication with the power source and is operable to provide an indicia, such as an illuminated lamp or an audible sound, when a power-only electrical connection is established between said electrical contacts and the power-and-data electrical connector.

According to one aspect, the low voltage power connector includes a switch in communication with the power source and with the indicator. The switch is operable to energize the indicator to provide the indicia upon engagement of the electrical receptacle by the power-and-data electrical connector or a power-only electrical connector. Optionally, the switch is operable to detect when an electrical connection is established between the electrical contacts and the power-and-data electrical connector. Optionally, the switch is mechanically actuated from an open condition to a closed condition in response to mechanical engagement of the power-and-data electrical connector or the power-only electrical connector with the electrical receptacle.

According to another aspect, the indicator includes a lamp that illuminates to provide the indicia is visible form. Optionally, the lamp is mounted to the front face of the connector housing.

According to yet another aspect, the connector housing includes two electrical receptacles, the front face defines two corresponding receptacle openings, and there are two lamps mounted to the front face of the connector housing. A first of the lamps illuminates in response to only a connection being made to a first of the electrical receptacles, and a second of the lamps illuminates in response to only a connection being made to a second of the electrical receptacles.

According to still another aspect, the electrical receptacle is any one or more of (i) a USB power-only receptacle, (ii) a USB power-and-data receptacle, and (iii) a serial data port with power capability.

According to a further aspect, the electrical receptacle is configured to alternately receive the power-and-data electrical connector and a power-only electrical connector. That is, the electrical receptacle is capable of receiving and electrically engaging the power-and-data electrical connector, and is also capable of receiving and electrically engaging a power-only electrical connector, which would have a similar mechanical configuration to the power-and-data electrical connector.

In another form of the present invention, a method is provided for establishing a data-secure electrical power connection to a portable electronic device. The method includes receiving, in an electrical-power-only receptacle, a power-and-data-capable connector that is in electrical communication with the portable electronic device. The electrical-power-only receptacle is accessed by the power-and-data-capable connector through a receptacle opening that is formed in a front face of a connector housing. The method further includes establishing an electrical-power-only connection between the power-and-data-capable electrical connector and at least two electrical contacts of the electrical-power-only receptacle, supplying only electrical power to the power-and-data-capable electrical connector via the electrical contacts upon engagement of the electrical contacts by the power-and-data-capable electrical connector, and selectively activating an indicator, such as an electric lamp, to provide a visible or audible indicia to a user when the electrical power connection is established between the electrical contacts of the electrical-power-only receptacle and the power-and-data-capable electrical connector.

Thus, the data-secure electrical power receptacle of the present invention provides users of portable electronic devices, and particularly devices utilizing single cables or connectors with both electrical power and electronic data capability, with an easily-perceived indication that a power-only (no data) connection has been established with the receptacle by power-and-data-capable connector of the user's portable electronic device.

These and other objects, advantages, purposes and features of the present invention will become apparent upon review of the following specification in conjunction with the drawings.

DESCRIPTION OF THE PREFERRED EMBODIMENTS

Figure 1:
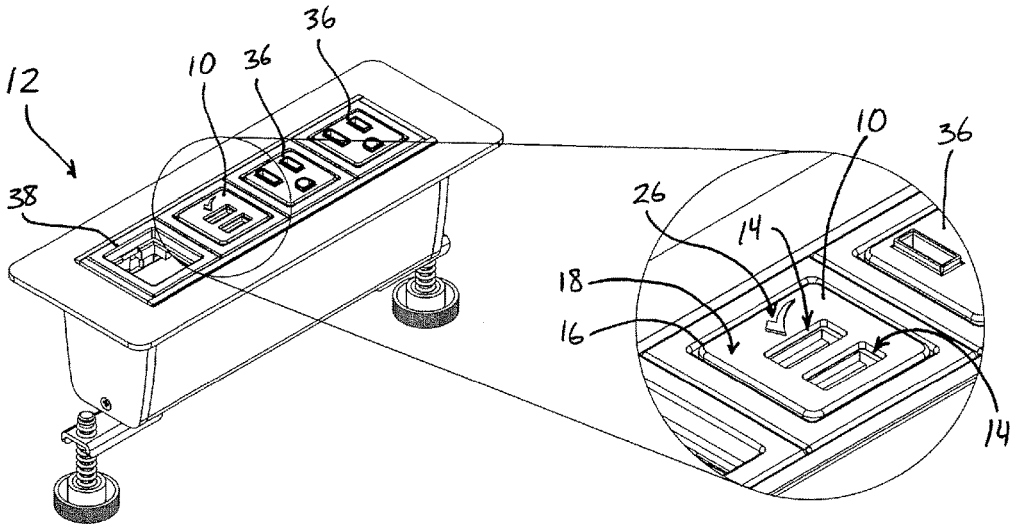
FIG. 1 is a perspective view of a dual outlet data-secure low voltage power connector in accordance with the present invention, shown mounted in an electrical power and/or data unit, and including an enlarged view of a portion thereof.

Referring now to the drawings and the illustrative embodiments depicted therein, a data-secure power connector 10 is configured for mounting to a power and/or data unit 12 (FIGS. 1 and 2) that is typically placed in a work area, such as along a table, desk, a shelf or countertop, a modular wall panel, or the like. However, it will be appreciated that the data-secure power connector 10 may be incorporated into substantially any surface or area where power is desired, including wall outlets, floor outlets, ceiling outlets, and outlets associated with extension cords, modular electrical systems, and the like. Data-secure power connector 10 is a power-only electrical receptacle that is capable of receiving and providing electrical power to compatible power-only plugs, and also to compatible power-and-data plugs, which may have substantially the same mechanical configuration as one another so as to establish a suitable power-only connection with data-secure power connector 10. Data-secure power connector 10 is not configured for transmitting or receiving electronic data signals. Although primarily described herein as having one or more low-voltage DC receptacles 14, such as a low-voltage USB receptacle, the present invention is not necessarily limited to low-voltage DC applications, and can be adapted for high-voltage AC applications without departing from the spirit and scope of the present invention.

Figure 2:
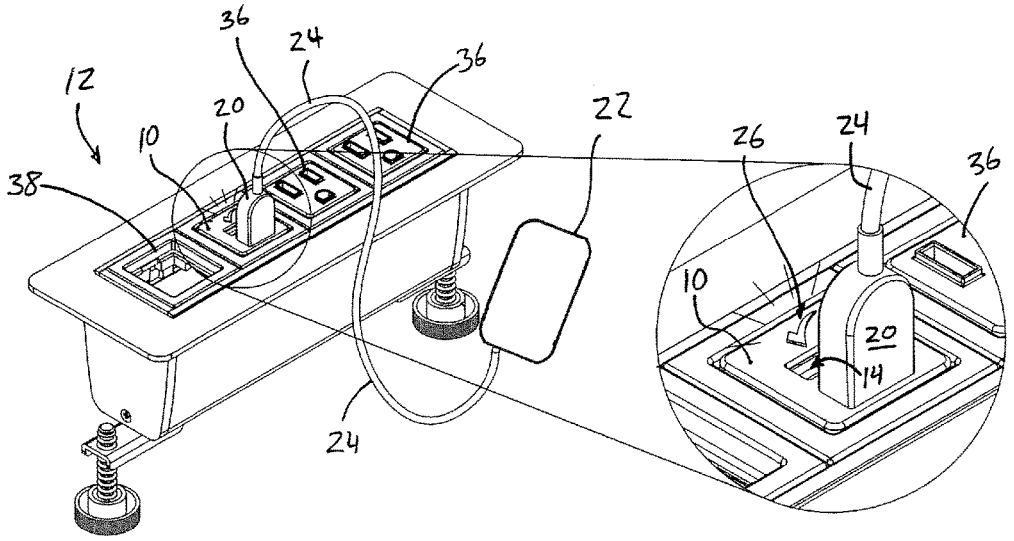
FIG. 2 is another perspective view of the data-secure low voltage power connector and electrical power and/or data unit of FIG. 1, shown with a power/data cord connected to the data-secure low voltage power connector, and including an enlarged view of a portion thereof.
Figure 3:
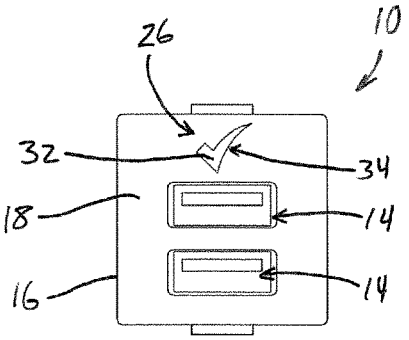
FIG. 3 is a front elevation of the dual outlet data-secure low voltage power connector of FIG. 1.
Figure 4:
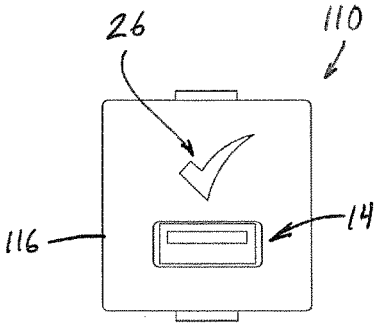
FIG. 4 is a front elevation of a single outlet data-secure low voltage power connector in accordance with the present invention.
Figure 5:
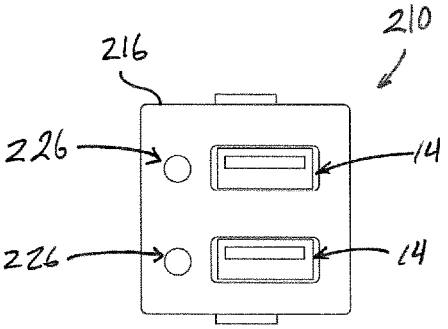
FIG. 5 is a front elevation of another dual outlet data-secure low voltage power connector in accordance with the present invention.

Data-secure power connector 10 includes a connector housing 16 having a front face 18 defining a pair of receptacle openings through which receptacles 14 are accessible by a power-and-data electrical connector 20 that is associated with an electrical consumer 22, such as a smart phone or tablet computer in communication with connector 20 via a power and data cord 24 (FIGS. 1 and 2). A data-secure indicia or indication is provided by an indicator light 26, which is located along front face 18, spaced from receptacles 14, and provides users with a visual indication when their device 22 has established a data-secure electrical connection with one of receptacles 14, as will be described below in more detail. A data-secure electrical connection is made when receptacle 14 only contains electrical power contacts and is thus incapable of exchanging electronic data through the compatible connector 20, or when receptacle 14 contains electronic data contacts in addition to electrical power contacts and the electronic data contacts are rendered incapable of exchanging electronic data through the compatible connector 20.

Figure 8:
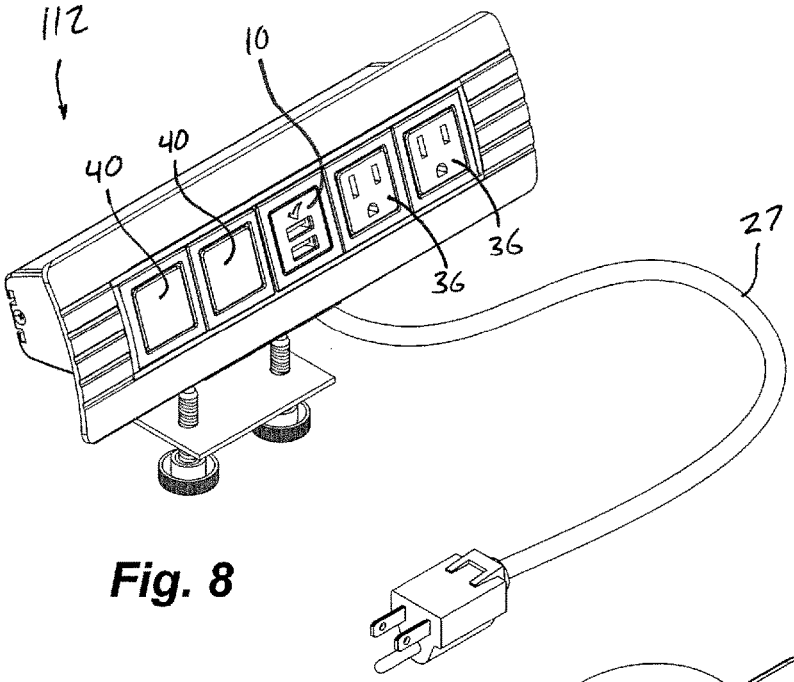
FIG. 8 is a perspective view of the dual outlet data-secure low voltage power connector of FIG. 1, shown mounted in another electrical power and/or data unit.
Figure 9:
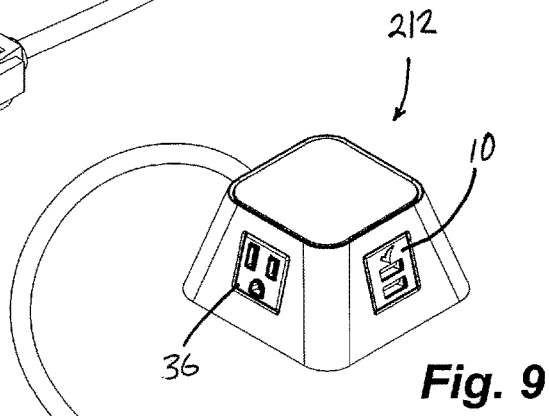
FIG. 9 is a perspective view of the dual outlet data-secure low voltage power connector of FIG. 1, shown mounted in another electrical power and/or data unit.
Figure 10:
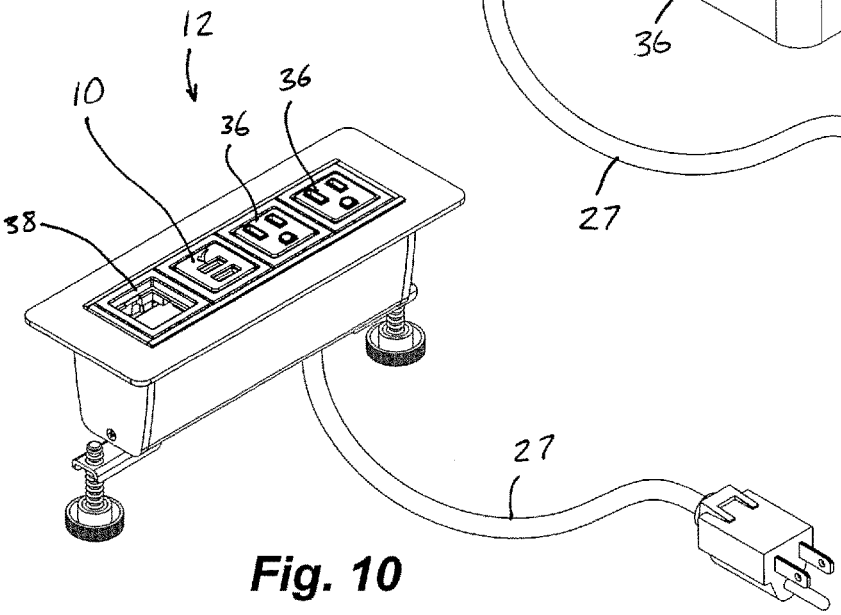
FIG. 10 is a perspective view of the dual outlet data-secure low voltage power connector of FIG. 1, shown mounted in another electrical power and/or data unit.

Inside the receptacles 14 are at least two electrical contacts that are electrically energized by a power source such as an external power source accessed via a power cord 27 such as shown in FIGS. 8 and 9 (using a DC power converter if the external power source provides AC current and the receptacles 14 are low voltage DC receptacles), an onboard power source such as a rechargeable battery or capacitor, or the like. Additional descriptions of power and/or data units with externally-powered low voltage DC receptacles and DC power converters may be found in commonly-owned U.S. Pat. No. 9,312,673, entitled "LOW VOLTAGE POWER RECEPTACLE," while additional descriptions of electrical power units with on-board rechargeable batteries supplying power to low voltage DC outlets may be found in commonly-owned U.S. provisional application, Ser. No. 62/306,879, filed Mar. 11, 2016 and entitled "FURNITURE MOUNTED CHARGING STATION," now U.S. patent application Ser. No. 15/456,941, filed Mar. 13, 2017, all of which are hereby incorporated herein by reference in their entireties.

Figure 6:
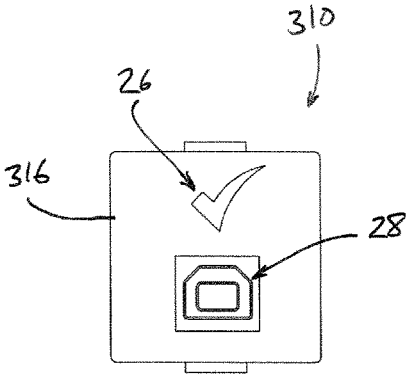
FIG. 6 is a front elevation of another single outlet data-secure low voltage power connector in accordance with the present invention.

Receptacles 14 may be conventional low voltage USB-A receptacles such as shown in FIGS. 1-5 and 8-10, USB-B receptacles 28 (FIG. 6), a USB-C or Lightning® connector 30 (FIG. 7), or one of various other styles of USB-mini receptacles, serial port receptacles with power capability, or the like (not shown). It will be appreciated that receptacles 14 represent substantially any electrical power receptacle that is capable of conveying electrical power to the electrical consumer, such as smart phone 22, upon engagement of the receptacle's electrical contacts by the power-and-data electrical connector 20. Typically, receptacles 14 will have a configuration (such as substantially any USB-style configuration) that is compatible with power-only or power-and-data plugs of the same or corresponding mechanical configuration, since these types of receptacles, in general, are configured for either power-only capability or power-and-data capability, and are not readily distinguishable from one another based on casual visual inspection.

Indicator 26 is in selective electrical communication with the power source, such as via a mechanical switch or electronic switching circuit, and when an electrical connection is established between the electrical contacts of receptacle 14 and the power-and-data electrical connector 20, indicator 26 illuminates to provide users with a positive visual indication confirming to the user that no electronic data connection has been established between receptacle 14 and their portable electronic device 22. The switch or switching circuit (not shown) is operable to detect when the electrical connection is established between the electrical contacts of receptacle 14 and the power-and-data electrical connector 20, and is operable to energize (illuminate) the indicator 26 to provide the indicia upon detecting the electrical connection, such as shown in FIG. 2. Optionally, the indicator switching may be accomplished by providing a separate or integrated printed circuit board (PCB) with micro-controller, which establishes connections to any data terminals present in connector 20, but without establishing connections to the connector's data terminals (if present) outside of the data-secure power connector, and using the micro-controller to provide a "secure" feedback signal that causes indicator 26 to illuminate.

In the illustrated embodiments of FIGS. 1-4 and 6-10, indicator 26 includes a translucent member 32 that is positioned in a correspondingly-shaped opening 34 formed in front face 18 (FIG. 3), through which a low voltage LED shines when energized (FIG. 2). Although the translucent member 32 is shaped as a checkmark in FIGS. 1-4 and 6-10, it will be appreciated that other shapes such as circular dots (226, FIG. 5) or other symbols or words may be used. Moreover, it is envisioned that other forms indicia may be used to indicate a data-secure connection has been established with the power connectors of the present invention, such as an audible tone or tones, or voice confirmation, without departing from the spirit and scope of the present invention.

Figure 7:
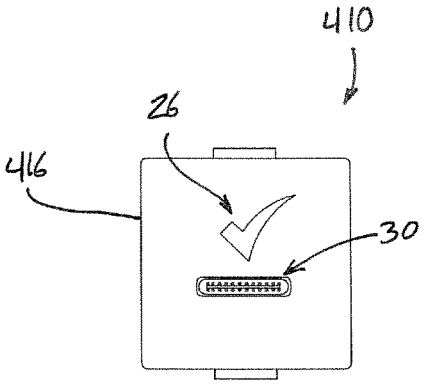
FIG. 7 is a front elevation of another single outlet data-secure low voltage power connector in accordance with the present invention.

In the illustrated embodiment of FIGS. 1-3 and 8-10, front face 18 defines two separate openings for two separate receptacles 14, and indicator 26 is operable to illuminate upon power-data electrical connector 20 establishing a connection with either of the receptacles 14. Other configurations are also envisioned, such as a data-secure power connector 110 having a housing 116 configured for a single receptacle 14 and single indicator 26 (FIG. 4), a data-secure power connector 210 having a housing 216 configured for two receptacles 14 each with its own respective indicator 226 (FIG. 5), a data-secure power connector 310 having a housing 316 configured for a USB-B receptacle 28 and indicator 26 (FIG. 6), and a data-secure power connector 410 having a housing 416 configured for a serial port receptacle 30 with power capability (FIG. 7).

In the illustrated embodiments, housings 16, 116, 216, 316, 416 are configured for sliding or inserting engagement with power and/or data unit 12, such as in a manner that will be understood with reference to commonly-owned U.S. Pat. No. 8,444,432, entitled "POWER AND DATA ADAPTER ASSEMBLY," with reference to commonly-owned U.S. Pat. No. 8,480,429, entitled "POWER DATA HOUSING," and with reference to commonly-owned U.S. Pat. No. 9,312,673, entitled "LOW VOLTAGE POWER RECEPTACLE," all of which are hereby incorporated herein by reference in their entireties. Power and/or data unit 12 (FIGS. 1, 2 and 10) is configured for insertion into a generally rectangular opening formed in a table or desk, or in a floor box, a wall or modular wall or room divider, a ceiling, or the like, while another power and/or data unit 112 (FIG. 8) is configured for mounting to the edge of a table or desk or wall panel, and yet another power and/or data unit 212 (FIG. 9) is a monument-style unit configured for resting atop a table or desk or shelf, for example. The power and/or data units 12, 112, 212 may also support one or more high voltage AC receptacles 36 (FIGS. 1, 2 and 8-10), may support or define framed openings 38 (FIGS. 1, 2 and 10) to permit passage of wires or insertion of another receptacle (not shown), and may support blank plugs or lights or other functional inserts 40 (FIG. 8), as will be readily understood with reference to the above-referenced patents and applications that are incorporated herein by reference.

Therefore, the data-secure low voltage power receptacle provides a power-only electrical connection for both power-only and power-and-data-capable plugs, which provides users with a clear indication that they have established a power-only connection between their device's power-only plug or power-and-data-capable plug and the receptacle, and that there has been no data connection established between the receptacle and a portable electronic device associated with the plug.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A data-secure low voltage power connector comprising:

a connector housing having a front face defining a receptacle opening;

an electrical-power-only receptacle accessible through said receptacle opening and configured to receive a power-and-data electrical connector associated with an electrical consumer, the power-and-data electrical connector comprising two electrical power receiving contacts and an electronic data contact;

said electrical-power-only receptacle comprising at least two electrical contacts that are electrically energized by a power source and are configured to convey only electrical power to the electrical consumer upon engagement of said electrical contacts by the electrical power receiving contacts of the power-and-data electrical connector; and an indicator at said connector housing and in selective electrical communication with the power source, said indicator configured to provide an indicia when an electrical connection is established between said electrical contacts and the power-and-data electrical connector;

wherein said electrical-power-only receptacle is configured so as not to establish electrical continuity to the electrical consumer via the electronic data contact of the power-and-data electrical connector.

2. The low voltage power connector of claim 1, further comprising a switch in communication with the power source and with said indicator, wherein said switch is operable to energize said indicator to provide the indicia upon engagement of said electrical-power-only receptacle by the power-and-data electrical connector or a power-only electrical connector.

3. The low voltage power connector of claim 2, wherein said switch is operable to detect an electrical connection established between said electrical contacts and the power-and-data electrical connector.

4. The low voltage power connector of claim 2, wherein said switch is mechanically actuated from an open condition to a closed condition in response to mechanical engagement of the power-and-data electrical connector or the power-only electrical connector with said electrical-power-only receptacle.

5. The low voltage power connector of claim 1, wherein said indicator comprises a lamp that is operable to illuminate to provide the indicia.

6. The low voltage power connector of claim 5, wherein said lamp is mounted to said front face of said connector housing.

7. A data-secure low voltage power connector comprising:

a connector housing having a front face defining at least two receptacle openings;

at least two electrical receptacles accessible through said receptacle openings and configured to receive power-and-data electrical connectors associated with electrical consumers;

at least two electrical contacts associated with said electrical receptacle, wherein said electrical contacts are electrically energized by a power source and are configured to convey electrical power to the electrical consumer upon engagement of said electrical contacts by the power-and-data electrical connector; and at least two indicator lamps mounted to said front face of said connector housing and in selective electrical communication with the power source, said indicator lamps configured to illuminate to provide an indicia when an electrical connection is established between said electrical contacts and the power-and-data electrical connector;

wherein a first of said lamps provides a first of the indicias with respect to only a first of said electrical receptacles, and a second of said lamps provides a second of the indicias with respect to only a second of said electrical receptacles.

8. The low voltage power connector of claim 1, wherein said electrical-power-only receptacle is configured for engagement with at least one chosen from (i) a USB power-only receptacle, (ii) a USB power-and-data receptacle, and (iii) a serial data port with power capability.

9. The low voltage power connector of claim 1, wherein said electrical-power-only receptacle is configured to alternately receive the power-and-data electrical connector and a power-only electrical connector.

10. A data-secure low voltage power connector comprising:

a connector housing having a front face defining a receptacle opening;

an electrical-power-only receptacle accessible through said receptacle opening and configured to receive a power-and-data-capable electrical connector associated with a portable electronic device having electronic data transmission capability via the power-and-data-capable electrical connector, the power-and-data-capable electrical connector comprising two electrical power receiving contacts and an electronic data contact;

at least two electrical contacts disposed in said electrical-power-only receptacle, wherein said electrical contacts are electrically energizable by a power source and are configured to convey only electrical power to the portable electronic device upon engagement of said electrical contacts by the electrical power receiving contacts of the power-and-data-capable electrical connector;

an electrical switch disposed in said connector housing and configured to be electrically energized by the power source; and an electric lamp indicator at said front face of said connector housing and in selective electrical communication with the power source via said electrical switch;

wherein said electrical-power-only receptacle is configured so as not to establish electrical continuity to the electrical consumer via the electronic data contact of the power-and-data electrical connector; and wherein said electrical switch is configured to close and thereby establish electrical continuity between the power source and said electric lamp indicator in response to engagement of said electrical-power-only receptacle by the power-and-data-capable electrical connector, thereby illuminating said electric lamp indicator and providing a visual indication that a power-only connection has been established between said electrical-power-only receptacle and the power-and-data-capable electrical connector.

11. The low voltage power connector of claim 10, wherein said electrical switch is operable to detect an electrical connection established between said electrical contacts and the power-and-data-capable electrical connector.

12. The low voltage power connector of claim 10, wherein said electrical switch is mechanically actuated from an open condition to a closed condition in response to mechanical engagement of the power-and-data-capable electrical connector with said electrical receptacle.

13. The low voltage power connector of claim 10, comprising at least two of said electrical-power-only receptacles supported in said connector housing and at least two of said electric lamp indicators at said front face, wherein said front face defines two of said receptacle openings, wherein a first of said electric lamp indicators provides a first visual indication with respect to only a first of said electrical-power-only receptacles, and a second of said electric lamp indicators provides a second visual indication with respect to only a second of said electrical-power-only receptacles.

14. The low voltage power connector of claim 10, wherein said electrical-power-only receptacle comprises at least one chosen from a USB-style receptacle and a serial port.

15. The low voltage power connector of claim 10, wherein said electrical-power-only receptacle is configured to alternately receive the power-and-data-capable electrical connector and a power-only electrical connector.

16. The low voltage power connector of claim 10, further in combination with an electrical power and/or data unit, said electrical power and/or data unit comprising at least one high voltage AC electrical power receptacle adjacent said low voltage power connector.

17. A method of establishing a data-secure electrical power connection to a portable electronic device, said method comprising:

receiving, in an electrical-power-only receptacle, a power-and-data-capable connector that comprises two electrical power contacts and at least one electronic data contact and is in electrical communication with the portable electronic device, wherein the electrical-power-only receptacle is accessed through a receptacle opening formed in a front face of a connector housing;

establishing an electrical-power-only connection between only the two electrical power contacts of the power-and-data-capable electrical connector and at least two electrical contacts of the electrical-power-only receptacle;

supplying only electrical power to the power-and-data-capable electrical connector via the at least two electrical contacts upon engagement of the at least two electrical contacts by the power-and-data-capable electrical connector; and selectively activating an indicator at the connector housing to provide a visible or audible indicia to a user when the electrical power connection is established between the electrical contacts of the electrical-power-only receptacle and the power-and-data-capable electrical connector.

18. The method of claim 17, wherein said selectively activating the indicator comprises illuminating an electric lamp at the front face of the connector housing.

19. The method of claim 17, wherein said selectively activating the indicator comprises closing an electrical switch disposed in the connector housing upon engagement of the electrical-power-only receptacle with the power-and-data-capable electrical connector, wherein the switch is in electrical communication with a power source.

* * * * *